US008820283B2

(12) United States Patent
Brodbeck et al.

(10) Patent No.: US 8,820,283 B2
(45) Date of Patent: Sep. 2, 2014

(54) INTERNAL COMBUSTION ENGINE

(71) Applicant: Mahle International GmbH, Stuttgart (DE)

(72) Inventors: Luke Brodbeck, Brighton, MI (US); Thomas Flender, Eberdingen (DE); Michael Kreisig, Stuttgart (DE); Falk Schneider, Korntal-Muenchingen (DE); Antonio Menonna, Ditzingen (DE); Stefan Steichele, Gerlingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/865,736

(22) Filed: Apr. 18, 2013

(65) Prior Publication Data

US 2013/0276734 A1 Oct. 24, 2013

(30) Foreign Application Priority Data

Apr. 19, 2012 (DE) ..... 10 2012 206 500

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | | |
|---|---|---|---|---|
| 7,469,670 | B2 | 12/2008 | Rommel et al. | |
| 7,513,232 | B2 | 4/2009 | Schneider | |
| 7,536,986 | B2 | 5/2009 | Schneider | |
| 8,051,818 | B2 * | 11/2011 | Myers et al. | 123/90.17 |
| 2007/0272183 | A1 | 11/2007 | Schneider | |
| 2007/0295296 | A1 | 12/2007 | Lettmann et al. | |
| 2010/0093453 | A1 | 4/2010 | Myers et al. | |

FOREIGN PATENT DOCUMENTS

| | | | |
|---|---|---|---|
| DE | 102005040934 | A1 | 8/2006 |
| DE | 102006024793 | A1 | 11/2007 |
| DE | 102006024794 | A1 | 12/2007 |
| DE | 102006028611 | A1 | 12/2007 |
| DE | 102009041755 | A1 | 4/2010 |
| EP | 1860286 | A2 | 11/2007 |
| WO | WO-2008/075094 | A1 | 6/2008 |
| WO | WO-2009/067789 | A1 | 6/2009 |

OTHER PUBLICATIONS

European Search Report for EP-13160288.0, dated Jun. 10, 2013.

* cited by examiner

*Primary Examiner* — Ching Chang
(74) *Attorney, Agent, or Firm* — Rader, Fishman & Grauer PLLC

(57) ABSTRACT

A camshaft may have an inner shaft and an outer shaft, each rotatable relative to the other. An adjusting device may include a first phase adjuster and a second phase adjuster. The outer shaft may be mounted in a stationary counter bearing adjacent to the adjusting device and the adjusting device may have a first phase adjuster and a second phase adjuster. The counter bearing may be designed as a slide bearing and oil supply to the phase adjusters may take place via the slide bearing. The slide bearing may have a first, second and third oil channel. The first oil channel may act on the first phase adjuster with corresponding oil flows, the second oil channel may act on the second phase adjuster with a first oil flow, and the third oil channel may act on the second phase adjuster with a second oil flow.

20 Claims, 1 Drawing Sheet

INTERNAL COMBUSTION ENGINE

CROSS-REFERENCE TO RELATED APPLICATION

This application claims priority to German Patent Application 10 2012 206 500.8, filed Apr. 19, 2012, which is hereby incorporated by reference in its entirety.

TECHNICAL FIELD

The present invention relates to an internal combustion engine having at least one camshaft which comprises two shafts, namely an inner and an outer shaft which are in each case firmly connected to cams and which, moreover, are rotatable relative to each other, according to the preamble of the claim 1. The invention further relates to a motor vehicle provided with such an internal combustion engine.

BACKGROUND

From DE 10 2005 040 934 A1, a generic internal combustion engine having an adjustable camshaft is known, wherein the camshaft has two shafts, namely an inner and an outer shaft which are in each case firmly connected to cams and which are rotatable relative to each other. For generating the relative movement, a hydraulic adjusting device is provided at one end of the camshaft. In order to enable an installation space as small as possible for feeding the hydraulic fluid necessary for operating the hydraulic adjusting device, the hydraulic fluid is fed to the hydraulic adjusting device via a suitably formed counter bearing.

Generic internal combustion engines with adjustable camshafts are well known, wherein in the internal combustion engine of the above paragraph known from the prior art, feeding the hydraulic fluid to the hydraulic adjusting mechanism requires installation space that should not be underestimated.

SUMMARY

The present invention is therefore concerned with the problem of proposing for an internal combustion engine of the generic kind an improved embodiment which in particular enables installation-space-optimized supply to at least two phase adjusters of a camshaft.

This problem is solved according to the invention by the subject matters of the independent claims. Advantageous embodiments are subject matter of the dependent claims.

The present invention is based on the general idea of feeding an oil supply to two phase adjusters of an adjustable camshaft through a counter bearing designed as a slide bearing and to provide in the slide bearing only three oil channels instead of four, as done until now. For this purpose, the internal combustion engine according to the invention thus has a camshaft comprising two shafts, namely an inner and an outer shaft which are in each case firmly connected to cams and are rotatable relative to each other. Such camshafts are usually designates as cam-in-cam camshafts. For generating a relative rotation between the two shafts and between the outer shaft and a crankshaft, two phase adjusters are provided that are arranged along the camshaft at the end side thereof. Adjacent to the phase adjusters, the outer shaft is mounted in a stationary counter bearing designed as a slide bearing. According to the invention, oil supply to the phase adjusters takes place via the counter bearing with a first oil channel that runs from the slide bearing through the outer shaft into the inner shaft, and in the inner shaft via an axial bore to a valve that acts on the phase adjuster of the inner shaft with corresponding oil flows. Via a second oil channel that runs from the slide bearing through the outer shaft and further between the outer shaft and the inner shaft to the phase adjuster of the outer shaft, said phase adjuster is acted on by a first oil flow that enables a rotation of the outer shaft in a first direction, for example, a counterclockwise direction. Via a third oil channel that runs from the slide bearing through the outer shaft and further between the outer shaft and the inner shaft into an oil guiding sleeve to the phase adjuster of the outer shaft, said phase adjuster is acted on by a second oil flow that effects an opposite rotation of the outer shaft, thus, for example, in clockwise direction. By supplying the phase adjuster adjusting the inner shaft via only a single oil channel, namely the first oil channel, which downstream of the valve is divided into two oppositely acting directions, the previously required fourth oil channel can be eliminated, as a result of which the counter bearing can be built significantly more compact in particular in the axial direction. At the same time, the oil supply for the two phase adjusters via the camshaft can be configured in a comparatively simple and cost-effective manner, wherein the phase adjuster of the inner shaft, which phase adjuster is arranged in the axial direction on the front side of the camshaft, is supplied with oil through a bore in the inner shaft. In addition, in this region there is space enough to accommodate the valve. With this improved oil supply according to the invention, the oil that is already present in the slide bearing configured according to the invention can be used not only for lubricating, but in addition also for controlling the two phase adjusters.

In an advantageous refinement of the solution according to the invention, the first oil channel between the outer shaft and the inner shaft is sealed with respect to the second oil channel by sealing rings. Such sealing rings allow a relative rotation between the inner shaft and the outer shaft; however, they completely seal the first oil channel with respect to the second oil channel, wherein the sealing rings can be configured as usual sealing rings made from plastic.

Expediently, the valve for switching the phase adjuster for the inner shaft is designed as an electromagnetic valve. Such electromagnetic valves, on the one hand, switch extremely precisely and thus enable an extremely exact engine control and, on the other, they are comparatively inexpensive, which is of advantage for a cost-effective and economical production of the internal combustion engine according to the invention.

Expediently, two axial shoulders are arranged adjacent to the slide bearing on the outer shaft and support the camshaft in the axial direction on the slide bearing. Here, the two axial shoulders are formed like rings which are connected to the outer shaft in a rotationally fixed manner and are fixed on the outer shaft, axially adjacent to the slide bearing. The two axial shoulders thus enable an axial mounting of the camshaft at the slide bearing so that a separate axial bearing such as, for example, a thrust washer, the installation of which is complicated and the production of which is expensive, can be eliminated.

In an advantageous refinement of the solution according to the invention, sealing rings are arranged between the outer shaft and the slide bearing, which sealing rings seal the individual oil channels with respect to each other. Such sealing rings can be designed in the same manner as the sealing rings between the outer and the inner shafts and serve for bordering the individual oil flows or oil channels. Such sealing rings, for example, can again be made of plastic but also of metal, and in particular together with the two axial shoulders, they enable a labyrinth sealing that prevents excessive oil discharge from the slide bearing into the cylinder head.

In a further advantageous embodiment, the slide bearing has circumferentially extending ring grooves for each oil channel. This has the great advantage that, purely theoretically, only a single through-opening per ring groove or oil channel has to be provided since the oil flow, extending from the slide bearing, spreads throughout the ring groove and therefore is in fluid connection to the following oil channel in each rotational position of the camshaft or the outer shaft via the through-opening in the outer shaft. Of course, it is also possible that two, in particular two opposing through-openings are provided in the camshaft, that is, in the outer shaft of the camshaft, whereby a particularly continuous oil supply is made possible.

Further important features and advantages of the invention arise from the sub-claims, from the drawings, and from the associated description of the figures based on the drawings.

It is to be understood that the above-mentioned features and the features still to be explained hereinafter are usable not only in the respective mentioned combination but also in other combinations or alone without departing from the context of the present invention.

Preferred exemplary embodiments of the invention are illustrated in the drawings and are explained in more detail in the following description, wherein identical reference numbers refer to identical, or similar, or functionally identical components.

BRIEF DESCRIPTION OF THE DRAWINGS

In the figures, schematically.

DETAILED DESCRIPTION

Figure 1:
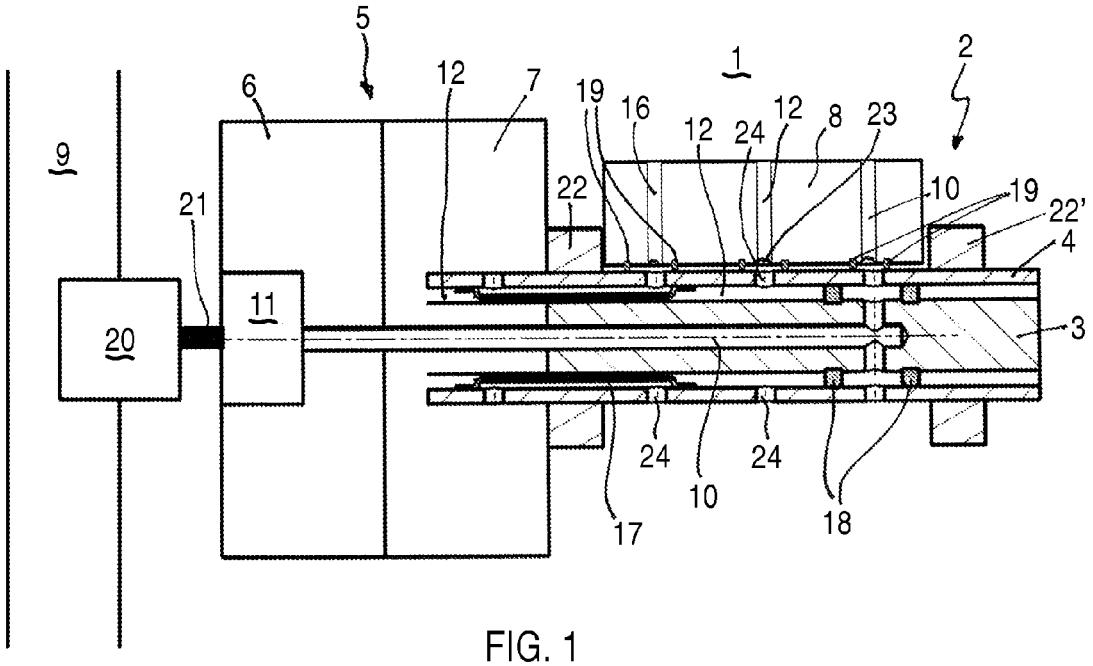
FIG. 1 shows a sectional view through an internal combustion engine according to the invention in the region of a longitudinal end of a camshaft.
Figure 2:
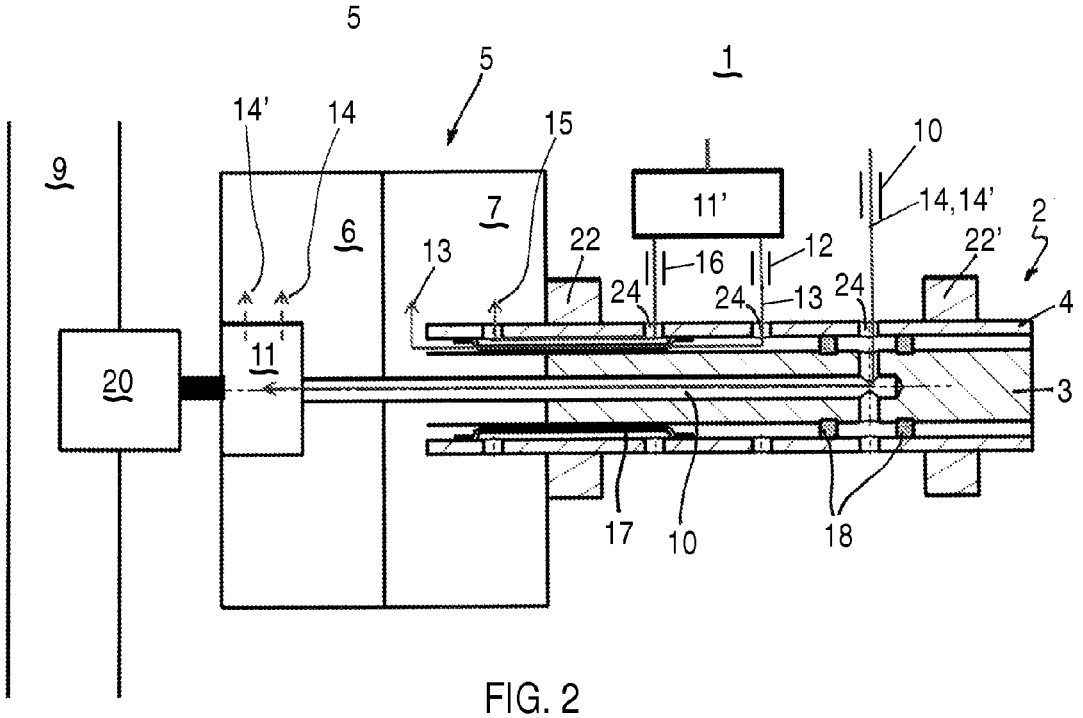
FIG. 2 shows an illustration as in FIG. 1, but without slide bearing and with indicated oil flows for supplying the two phase adjusters.

According to the FIGS. 1 and 2, an internal combustion 1 engine according to the invention has at least one camshaft 2 that is designed as a so-called shiftable camshaft 2, and two shafts 3 and 4, namely an inner shaft 3 and an outer shaft 4 which are each firmly connected to non-illustrated cams and are rotatable relative to each other. Also provided is an adjusting device 5 comprising two phase adjusters 6 and 7 for generating, on the one hand, a relative rotation between the inner shaft 3 and the outer shaft 4 and, on the other, for adjusting the phase of the camshaft 2 relative to a non-illustrated crankshaft of the internal combustion engine 1. The camshaft 2 is mounted via a counter bearing designed as a slide bearing 8, which counter bearing is arranged stationarily adjacent to the adjusting device 5 in a cylinder head 9. According to the invention, oil supply to the phase adjusters 6 and 7 takes place via the slide bearing 8, namely with a first oil channel 10 which runs from the slide bearing 8 through the outer shaft 4 into the inner shaft 3, and in the inner shaft 3 to a valve 11 that acts on the phase adjuster 6 of the inner shaft 3 with corresponding oil flows 14 and 14' and depending on the valve position, can effect a rotation of the inner shaft 3 relative to the outer shaft 4. Via a second oil channel 12 that runs from the slide bearing 8 through the outer shaft 4 and further between the outer shaft 4 and the inner shaft 3 to the phase adjuster 7 of the outer shaft, said phase adjuster is acted on with a first oil flow 13 (cf. FIG. 2). A second oil flow 15 in the direction opposite to the first oil flow 13 is fed via a third oil channel 16 (cf. FIG. 1) that runs from the slide bearing 8 through the outer shaft 4 and further between the outer shaft 4 and the inner shaft 3 into an oil guiding sleeve 17 to the phase adjuster 7 of the outer shaft 4. The designation "opposite oil flow directions" refers only to the fact that the first oil flow 3 effects a rotation of the outer shaft 4 relative to the crankshaft in a direction opposite to the direction effected by the second oil flow 15. With the oil flow path according to the invention in the slide bearing 8 and in particular within the camshaft 2, the previously required four oil channels can now be reduced to three oil channels 10, 12 and 16 in the slide bearing 8, whereby said slide bearing has a more compact design and can be structured in a technically simpler manner.

Between the outer shaft 4 and the inner shaft 3, the first oil channel 10 is sealed with respect to the second oil channel 12 by means of sealing rings 18, as illustrated according to FIG. 1. In a similar manner, sealing rings 19 are also arranged between the outer shaft 4 and the slide bearing 8, which sealing rings seal the individual oil channels 10, 12 and 16 with respect to each other. The sealing rings 18 and/or 19 can be configured as known plastic seals; however, they can also be of metallic nature.

When viewing the FIGS. 1 and 2, it is apparent that the valve 11 is arranged on the front side of the phase adjuster 6 for the inner shaft 3, wherein an actuator 20 for adjusting the valve 11 can be arranged, for example, on the cylinder head 9 and can effect the adjustment of the valve 11 via a corresponding tappet 21. Thus, the valve 11 can be designed, for example, as an electromagnetic valve.

Adjacent to the slide bearing 8, two axial shoulders 22 and 22' are arranged on the outer shaft 4, which shoulders support the camshaft 2 in the axial direction on the slide bearing 8. The individual oil channels 10, 12, 16 run substantially parallel in the slide bearing 8, as illustrated according to FIG. 1, wherein, however, another path of the oil channels 10, 12 and 16 is also conceivable. For a continuous oil supply to the phase adjusters 6 and 7, the slide bearing 8 has circumferentially extending ring grooves 23 for each oil channel 10, 12 and 16 so that oil supply to the phase adjusters 6, 7 is independent of the rotation angle position of the camshaft 2. In the outer shaft 4, at least one through-opening 24 per ring groove 23 is provided, wherein it is of course also possible that two opposing through-openings 24 are provided, as shown according to the FIGS. 1 and 2. Through the ring grooves 23, the arriving oil flows 13 and 15, for example, spread throughout the entire circumference of the outer shaft 4 in the region between the sealing rings 19, whereby a continuous flow of oil through the through-openings 24 can be ensured.

The oil guiding sleeve can be configured as a simple sheet metal part and thus can be inexpensive.

With the camshaft 2 according to the invention and in particular with the internal combustion engine 1 provided therewith, a cam-in-cam camshaft 2 comprising two phase adjusters 6, 7 can be supplied with oil in an installation-space-optimized manner, and therefore, the oil flow path in the camshaft 2 and/or in the slide bearing 8 can be implemented in a comparatively simple and cost-effective manner.

FIG. 2 illustrates a further valve 11' which switches the first oil flow 13 and the second oil flow 15 for the phase adjuster 7 of the outer shaft 4. The valve 11' can be arranged in the cylinder head, for example.

The invention claimed is:

1. An internal combustion engine with at least one camshaft, comprising:

an inner shaft and an outer shaft rotatable relative to each other, an adjusting device including at least one phase adjuster, wherein the outer shaft is mounted in a stationary counter bearing adjacent to the adjusting device, the adjusting device having a first phase adjuster and a second phase adjuster, wherein the counter bearing is designed as a slide bearing, and wherein oil supply to the phase adjusters takes place via the slide bearing with a first oil channel extending from the slide bearing through the outer shaft into the inner shaft, and from the inner shaft to a valve, the first oil channel configured to act on the first phase adjuster of the inner shaft with corresponding oil flows, a second oil channel extending from the slide bearing through the outer shaft into an opening between the outer shaft and the inner shaft to the second phase adjuster of the outer shaft, the second oil channel configured to act on the second phase adjuster with a first oil flow, a third oil channel extending from the slide bearing through the outer shaft into an oil guiding sleeve arranged between the outer shaft and the inner shaft and from the oil guiding sleeve to the second phase adjuster of the outer shaft, the third oil channel configured to act on the second phase adjuster with a second oil flow.

2. The internal combustion engine according to claim 1, wherein the first oil channel arranged between the outer shaft and the inner shaft is sealed with respect to the second oil channel by sealing rings.

3. The internal combustion engine according to claim 2, wherein the valve is arranged on a front side of the first phase adjuster for the inner shaft, and further comprising an actuator arranged on a cylinder head.

4. The internal combustion engine according to claim 3, wherein the valve is an electromagnetic valve.

5. The internal combustion engine according to claim 4, further comprising two axial shoulders arranged adjacent to the slide bearing on the outer shaft to support the camshaft in the axial direction on the slide bearing.

6. The internal combustion engine according to claim 5, wherein at least two of the oil channels in the slide bearing extend parallel to each other.

7. The internal combustion engine according to claim 6, further comprising a plurality of sealing rings arranged between the outer shaft and the slide bearing to seal the individual oil channels with respect to each other.

8. The internal combustion engine according to claim 7, wherein the slide bearing has circumferentially extending ring grooves for each oil channel.

9. The internal combustion engine according to claim 8, wherein the outer shaft defines at least one through-opening for each ring groove.

10. The internal combustion engine according to claim 2, wherein the valve is an electromagnetic valve.

11. The internal combustion engine according to claim 2, further comprising two axial shoulders arranged adjacent to the slide bearing on the outer shaft to support the camshaft in the axial direction on the slide bearing.

12. The internal combustion engine according to claim 2, wherein at least two of the oil channels in the slide bearing extend parallel to each other.

13. The internal combustion engine according to claim 2, further comprising a plurality of sealing rings arranged between the outer shaft and the slide bearing to seal the individual oil channels with respect to each other.

14. The internal combustion engine according to claim 1, wherein the valve is arranged on a front side of the first phase adjuster for the inner shaft, and further comprising an actuator arranged on a cylinder head at the valve.

15. The internal combustion engine according to claim 1, wherein the valve is an electromagnetic valve.

16. The internal combustion engine according to claim 1, further comprising two axial shoulders arranged adjacent to the slide bearing on the outer shaft to support the camshaft in the axial direction on the slide bearing.

17. The internal combustion engine according to claim 1, wherein at least two of the oil channels in the slide bearing extend parallel to each other.

18. The internal combustion engine according to claim 1, further comprising a plurality of sealing rings arranged between the outer shaft and the slide bearing to seal the individual oil channels with respect to each other.

19. The internal combustion engine according to claim 1, wherein the slide bearing has circumferentially extending ring grooves for each oil channel.

20. The internal combustion engine according to claim 19, wherein the outer shaft defines at least one through-opening for each ring groove.

* * * * *